US008128437B2

(12) United States Patent
Straka et al.

(10) Patent No.: US 8,128,437 B2
(45) **Date of Patent: *Mar. 6, 2012**

(54) METHOD AND SYSTEM FOR REDUCING INTERNAL CROSSTALK AND COMMON MODE SIGNAL GENERATION WITHIN A PLUG/JACK COMBINATION

(75) Inventors: Frank M. Straka, Chicago, IL (US); Masud Bolouri-Saransar, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/095,412

(22) Filed: Apr. 27, 2011

(65) Prior Publication Data

US 2011/0237136 A1 Sep. 29, 2011

Related U.S. Application Data

(63) Continuation of application No. 12/338,364, filed on Dec. 18, 2008, now Pat. No. 7,955,139.

(60) Provisional application No. 61/014,832, filed on Dec. 19, 2007.

(51) Int. Cl.
*H01R 24/00* (2006.01)

(52) U.S. Cl. ..... 439/676

(58) Field of Classification Search ..... 439/676, 439/941, 404, 418, 540.1; 333/24 C, 260
See application file for complete search history.

(56) References Cited

U.S. PATENT DOCUMENTS

| | | | | |
|---|---|---|---|---|
| 6,113,400 | A | 9/2000 | Martin et al. | |
| 6,379,157 | B1 | 4/2002 | Curry et al. | |
| 7,038,554 | B2 | 5/2006 | Seefried | |
| 7,140,924 | B2 | 11/2006 | Redfield et al. | |
| 7,201,618 | B2 | 4/2007 | Ellis et al. | |
| 7,530,854 | B2 * | 5/2009 | Aekins | 439/676 |
| 7,677,931 | B2 * | 3/2010 | Aekins | 439/676 |
| 7,736,195 | B1 * | 6/2010 | Poulsen et al. | 439/676 |
| 7,955,139 | B2 * | 6/2011 | Straka et al. | 439/676 |
| 7,967,645 | B2 * | 6/2011 | Marti et al. | 439/676 |
| 2005/0253662 | A1 | 11/2005 | Seefried | |
| 2007/0173120 | A1 | 7/2007 | Caveney et al. | |

FOREIGN PATENT DOCUMENTS

| | | | |
|---|---|---|---|
| WO | 2005101579 | A1 | 10/2005 |
| WO | 2007107206 | A1 | 9/2007 |

* cited by examiner

*Primary Examiner* — Chandrika Prasad
(74) *Attorney, Agent, or Firm* — Robert A. McCann; Christopher S. Clancy; Christopher K. Marlow

(57) ABSTRACT

A communication connector is described that includes a plug and a jack, into which the plug is inserted. The plug terminates a length of twisted pair cable. The jack includes a sled to support contacts for connecting to wires within the cable, a rigid circuit board that connects to the contacts, and a flex board that contacts the plug interface contacts. The jack also includes circuitry to compensate for crosstalk between wire pairs of the cable by adding capacitance values within the sled, rigid circuit board and/or flex board between traces carrying signals from the wire pairs so that crosstalk caused by the plug between wire pairs that have signals in phase cancels with crosstalk caused by the plug between signals out of phase, and so that the capacitance values added between each trace are about equal. The compensation is performed to reduce differential to common mode signal conversion.

20 Claims, 14 Drawing Sheets

Ideally, Want:

Plug/Jack Net Crosstalk(X) = $X_{31} + X_{62} - X_{23} - X_{16} = 0$

Ideally, Want:

Plug/Jack Net Crosstalk(X) = $X_{68} + X_{37} - X_{67} - X_{38} = 0$

| PAIR 45 | | PAIR 12 | | PAIR 36 | | PAIR 78 | |
|---|---|---|---|---|---|---|---|
| MARGIN | FREQ | MARGIN | FREQ | MARGIN | FREQ | MARGIN | FREQ |
| 1.94 | 455 | 3.49 | 498 | -2.72 | 454 | 1.91 | 449 |

| PAIR 45 | | PAIR 12 | | PAIR 36 | | PAIR 78 | |
|---|---|---|---|---|---|---|---|
| MARGIN | FREQ | MARGIN | FREQ | MARGIN | FREQ | MARGIN | FREQ |
| 2.57 | 455 | 2.92 | 453 | 1.55 | 496 | 4.02 | 450 |

METHOD AND SYSTEM FOR REDUCING INTERNAL CROSSTALK AND COMMON MODE SIGNAL GENERATION WITHIN A PLUG/JACK COMBINATION

CROSS-REFERENCE TO RELATED APPLICATIONS

This application is a continuation of U.S. patent application Ser. No. 12/338,364, filed Dec. 18, 2008, which claims priority to U.S. Provisional Patent Application No. 61/014,832, filed Dec. 19, 2007 and incorporates herein by reference in its entirety U.S. Provisional Patent Application No. 60/895,853, filed Mar. 20, 2007.

TECHNICAL FIELD

The present invention relates generally to electrical connectors, and more particularly to a modular communication jack design with crosstalk compensation that suppresses crosstalk present between conductors within a jack and/or plug.

BACKGROUND

In an electrical communication system, it is sometimes advantageous to transmit information (video, audio, data) in the form of differential signals over a pair of wires rather than a single wire, where the transmitted signal comprises the voltage difference between the wires without regard to the absolute voltages present. Each wire in a wire-pair is capable of picking up electrical noise from outside sources, e.g., neighboring data lines. Differential signals may be advantageous to use due to the fact that the signals are less susceptible to these outside sources.

When using differential signals, it is well known that it is desirable to avoid the generation of common mode signals. Common mode signals are related to a balance of the transmission line. Balance is a measure of impedance symmetry in a wire pair between individual conductors of the wire and ground. When the impedance to ground for one conductor is different than the impedance to ground for the other conductor, then differential mode signals are undesirably converted to common mode signals.

Another concern with differential signals is electrical noise that is caused by neighboring differential wire pairs, where the individual conductors on each wire pair couple (inductively or capacitively) in an unequal manner that results in added noise to the neighboring wire pair. This is referred to as crosstalk. Crosstalk can occur on a near end (NEXT) and a far end (FEXT) of a transmission line. It can also occur internally between differential wire pairs in a channel (referred to as internal NEXT and internal FEXT) or can couple to differential wire pairs in a neighboring channel (referred to as alien NEXT and alien FEXT). Generally speaking, so long as the same noise signal is added to each wire in the wire-pair, then the voltage difference between the wires will remain about the same and crosstalk is minimized.

In the communications industry, as data transmission rates have steadily increased, crosstalk due to undesired capacitive and inductive couplings among closely spaced parallel conductors within the jack and/or plug has become increasingly problematic. Modular connectors with improved crosstalk performance have been designed to meet the increasingly demanding standards. For example, recent connectors have introduced predetermined amounts of crosstalk compensation to cancel offending NEXT. Two or more stages of compensation are used to account for phase shifts from propagation delay resulting from a distance between a compensation zone and the plug/jack interface, which, in turn gives the system an increased bandwidth. Additionally, new standards have been particularly demanding in the area of alien crosstalk. Common mode signals are known to radiate more than differential signals, and therefore are a major source of alien crosstalk. Therefore, minimizing any sort of common mode signal is desirable, and this has driven the need for new connector designs.

Recent transmission rates, including those requiring a bandwidth in excess of 250 MHz, have exceeded the capabilities of the prior techniques for both internal NEXT and alien NEXT. Thus, improved compensation techniques are needed.

SUMMARY

Within embodiments disclosed below, a communication connector is described that includes a plug and a jack, into which the plug is inserted. The plug terminates a length of twisted pair communication cable. The jack includes a sled arranged to support interface contacts for connecting to wires within the twisted pair communication cable, a rigid circuit board that connects to the interface contacts, and a flex board that contacts the plug interface contacts.

The structure of the plug creates crosstalk that is then compensated for by the jack. Additionally, the unbalanced structure of the plug can create common mode signals that may be detrimental to alien crosstalk performance. Crosstalk can be added by the flex board and rigid board in order to compensate for the crosstalk from the plug. The crosstalk can be added in such a way that the crosstalk allows for internal NEXT and FEXT to pass at frequencies exceeding 500 MHz, while at the same time minimizing the creation of common mode signals, which ultimately improves alien crosstalk performance.

These and other aspects will become apparent to those of ordinary skill in the art by reading the following detailed description, with reference where appropriate to the accompanying drawings. Further, it should be understood that the embodiments noted herein are not intended to limit the scope of the invention as claimed.

DETAILED DESCRIPTION

The present application describes a communication connector that includes a plug and a jack, into which the plug is inserted. The jack includes circuitry to compensate for crosstalk between wire pairs of the plug by adding capacitance and mutual inductance between wires of the wire pairs.

Figure 1:
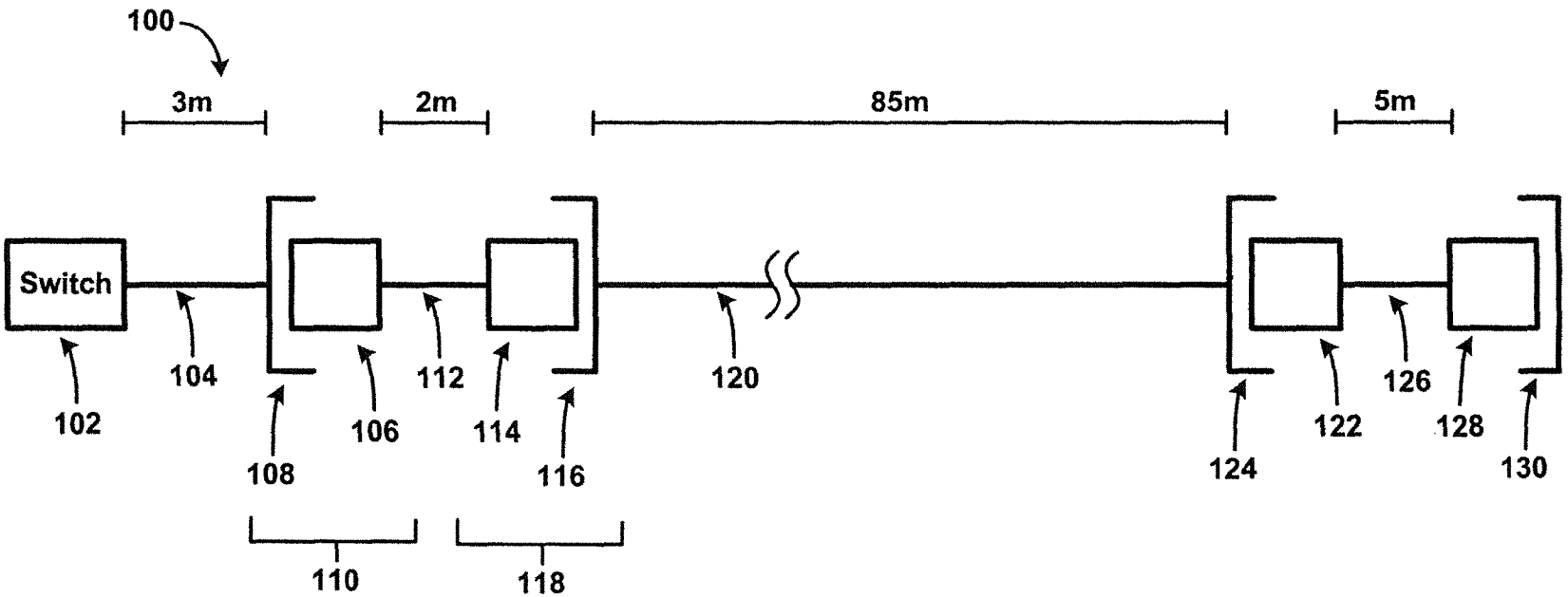
FIG. 1 illustrates an example of a transmission channel used to transmit information (video, audio, data) in the form of electrical signals over cabling.

Referring now to the figures, FIG. 1 illustrates a transmission channel 100 used to transmit information (video, audio, data) in the form of electrical signals over wire. The system is shown to include a switch 102, at which a patch cable 104 connects a plug 106/jack 108 connection at a patch panel 110. At the patch panel 110, the information may be routed through patch cable 112 to another plug 114/jack 116 connection at a second patch panel 118, for example. From there, the information may be routed over a long distance, e.g., 85 m, via a wire 120 to a plug 122/jack 124 connection that is present within a patch panel, for example. From the patch panel, the information is routed over a patch cable 126 to a plug 128/jack 130 connection. The plug/jack connections in FIG. 1 may be a registered jack (RJ) standardized physical interface for connecting telecommunications equipment or computer networking equipment. For example, the plug/jack connections may be RJ45 connections of the modular or punchdown connector type.

The connections shown in FIG. 1 may be compatible with Category 6A cabling, commonly referred to as Cat 6A, which is a cable standard for 10-Gigabit Ethernet and other network protocols that is backward compatible with the Category 6, Category 5/5e, and Category 3 cable standards. Category 6A features more stringent specifications for crosstalk and system noise, which can be particularly difficult for UTP solutions to pass. The cable standard provides performance of up to 500 MHz and is suitable for 10BASE-T/100BASE-TX, 1000BASE-T (Gigabit Ethernet), and 10GBASE-T (10-Gigabit Ethernet).

Figure 2:
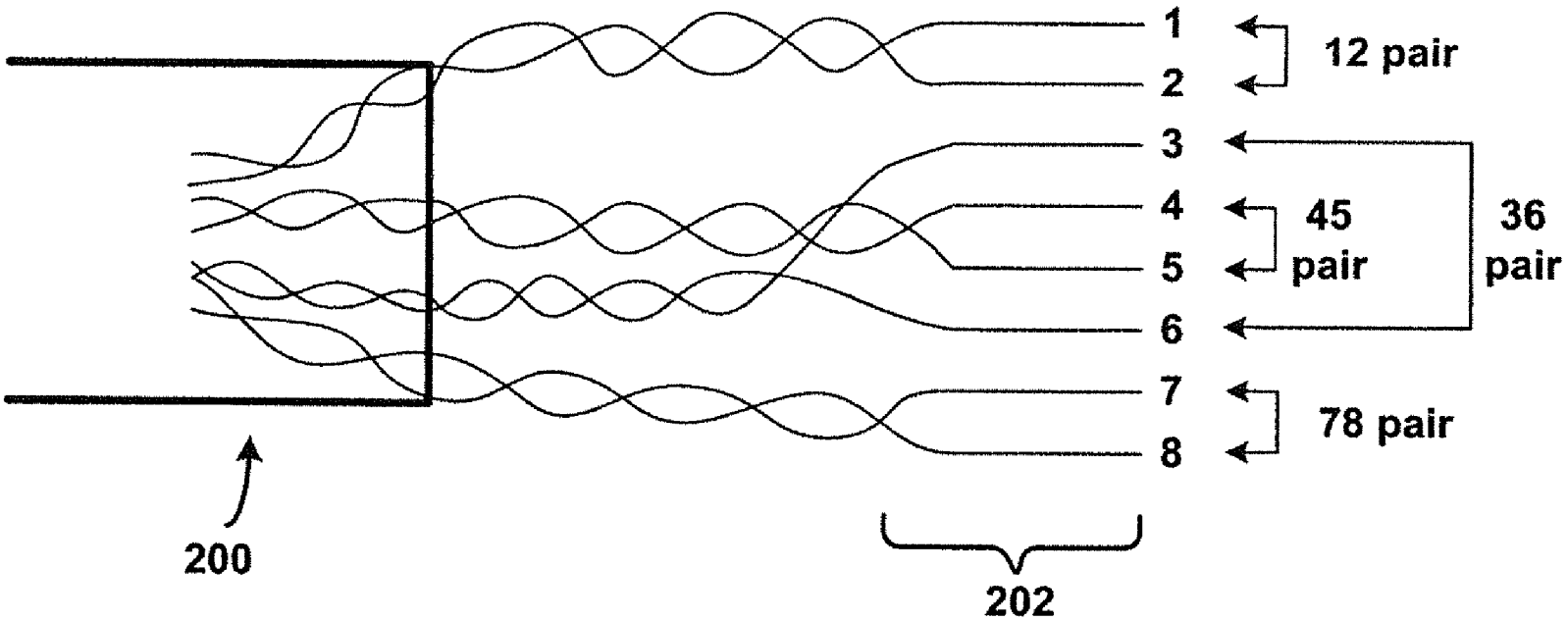
FIG. 2 illustrates an example conceptual cable that includes wires 1-8 illustrated in a manner as the wires are laid out in a plug.

Thus, the cables shown in FIG. 1 may each include four twisted copper wire pairs as laid out in a standard RJ45 plug. FIG. 2 illustrates a cable 200, which includes wires 1-8. In the configuration shown in FIG. 2, wires 1 and 2 are a twisted pair, wires 4 and 5 are a twisted pair, wires 3 and 6 are a twisted pair, and wires 7 and 8 are a twisted pair. Thus, there is overlapping between the 4 to 5 pair and the 3 to 6 pair, which adds significant crosstalk to pair combination 45-36. The wires 1-8 terminate at a plug 202, at which point the wires are untwisted.

The cable 200 includes twisted wire pairs for the purposes of minimizing electromagnetic interference (EMI) from external sources, electromagnetic radiation from the unshielded twisted pair (UTP) cable, and crosstalk between neighboring pairs.

Figure 3:
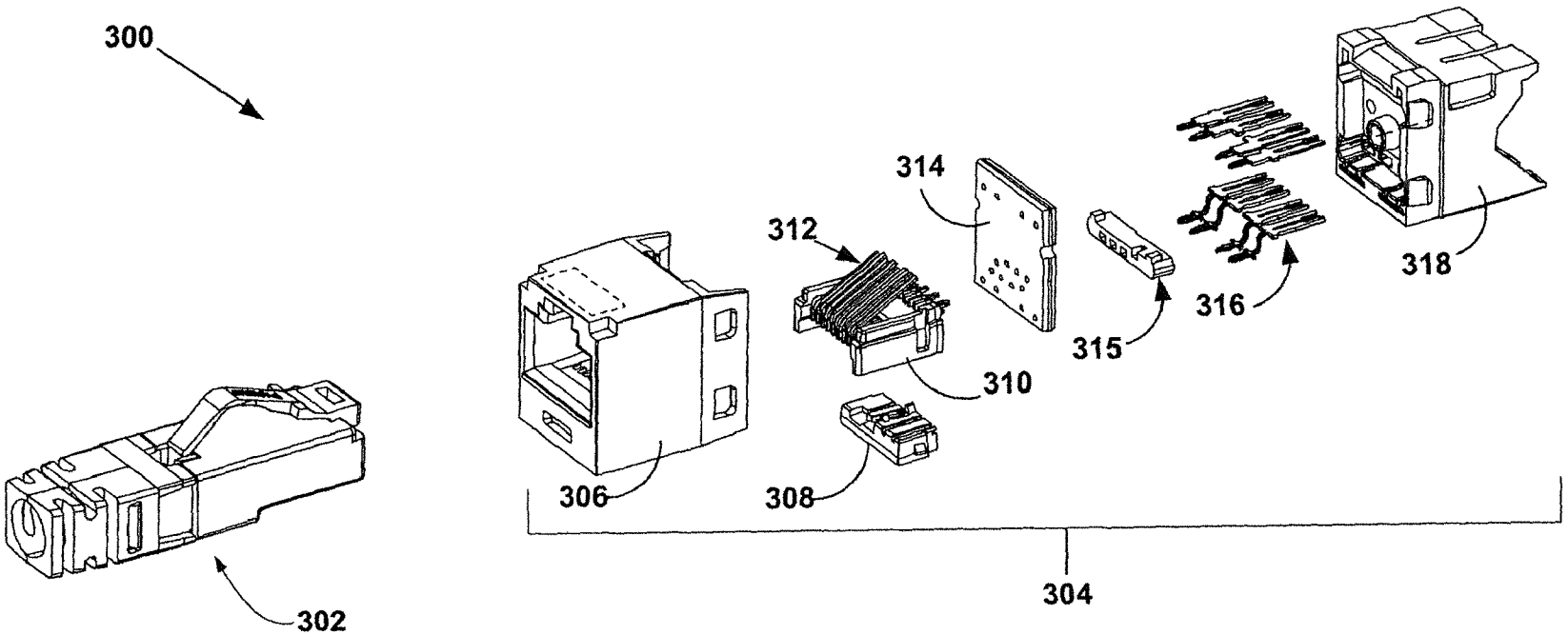
FIG. 3 is an exploded perspective illustration of an example communication connector that includes a plug and a jack, into which the plug may be inserted.

FIG. 3 is an exploded perspective illustration of a communication connector 300 that includes a plug 302 and a jack 304, into which the plug 302 may be inserted. The plug 302 terminates a length of twisted pair communication cable (not shown), while the jack 304 may be connected to another twisted-pair communication cable (not shown in FIG. 3).

As shown from left to right, the jack 304 includes a main housing 306 and a bottom front sled 308 and top front sled 310 arranged to support eight plug interface contacts 312. The plug interface contacts 312 engage a PCB (Printed Circuit Board) 314 from the front via through-holes in the PCB 314. As illustrated, an IDC (Insulation Displacement Contact) support 315 allows eight IDCs 316 to engage the PCB 314 from the rear via additional through-holes in the PCB 314. A rear housing 318 that has passageways for the IDCs 316 serves to provide an interface to a twisted pair communication cable.

Figure 6:
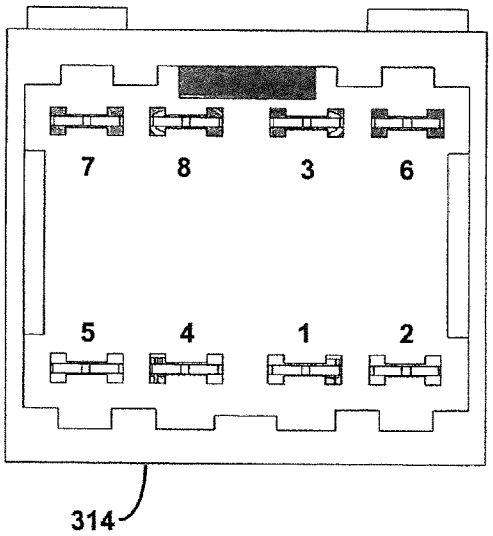
FIG. 6 illustrates a rear view of an example of the jack with the IDCs numbered to correspond to wire number pinouts on the PCB rigid board.
Figure 4:
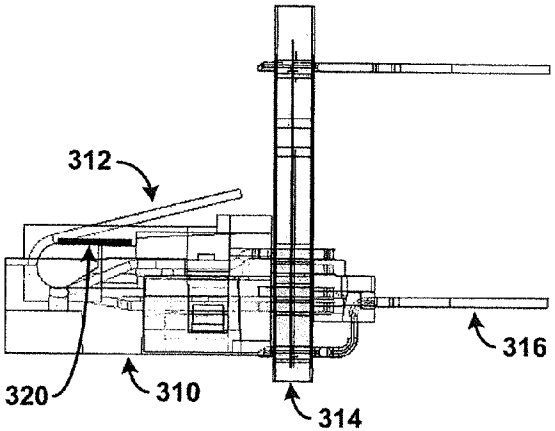
FIG. 4 illustrates a side view of an example of a sled and PCB rigid board configuration including interface contacts and IDCs.
Figure 5:
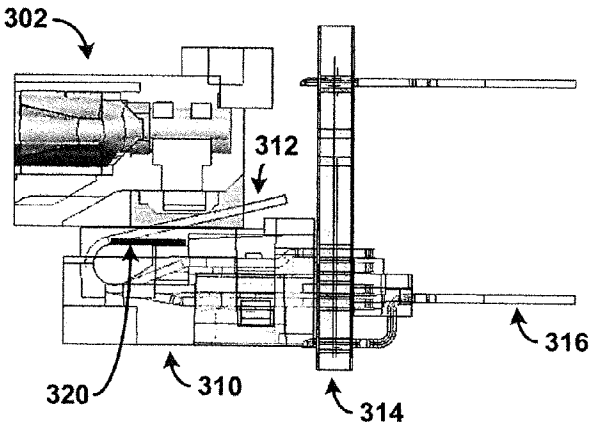
FIG. 5 illustrates a portion of an example plug contacting interface contacts of a jack.

FIG. 4 illustrates a side view of the sled 310 and PCB rigid board 314 configuration including the plug interface contacts 312 and the IDCs 316. FIG. 4 illustrates that the sled 310 also includes a flex board 320, which contacts the interface contacts 312 and contains circuitry to compensate for crosstalk. The flex board 320 may be a flexible PCB that includes capacitance and inductance to compensate for crosstalk. FIG. 5 illustrates a portion of the plug 302 contacting the interface contacts 312. FIG. 6 illustrates a rear view of the jack (PCB rigid board 314 is hidden from view) with the IDCs numbered to correspond to the wire number pinouts on the PCB rigid board 314.

Within the transmission system 100 in FIG. 1, data may be sent over the wires using differential signaling, which is a method of transmitting information electrically by means of two complementary signals sent on two separate wires. Using the cable shown in FIG. 2, the two complementary signals are sent over the wire pairs, e.g., over the 1 to 2 pair ("12 pair"). At the end of the connection of the wire, a receiving device reads a difference between the two complementary signals. Thus, any noise equally affecting the two wires will be cancelled because the two wires have similar amounts of electromagnetic interference. Differential mode transmission radiates less than common mode transmission.

In a typical transmission system, the cabling is more susceptible to common-mode crosstalk than differential mode crosstalk from other cables. A common-mode signal is one that appears in phase and with equal amplitudes on both lines of a two-wire cable with respect to a local common or ground. Such signals can arise, for example, from radiating signals that couple equally to both lines, a driver circuit's offset, a ground differential between the transmitting and the receiving locations, or unbalanced coupling between two differential pairs.

Using configurations of the cable as discussed herein, alien crosstalk (e.g., signal coupling from adjacent channels) from wire pairs in one cable to wire pairs in another cable can cause the system to fail requirements for CAT6A (EIA/TIA-568 or ISO). It is possible that adjacent channels can have significant common mode alien coupling that will occur on a UTP cable that is situated on a front end between the jacks. The common mode signal can be created by the plug-jack combination. Current CAT6A component requirements on a plug or jack may not be sufficient in reducing the common mode signals that can be generated in a plug/jack connection. Hence, a plug/jack that is compliant with the CAT6A standard can still create a channel or permanent link that will fail alien crosstalk requirements.

A standard RJ45 plug adds crosstalk into a signal that needs to be compensated for by the jack. On wire pairs 36-12 and 36-78, a crosstalk signal is added mainly by the plug by wire 2 coupling with wire 3, and wire 6 coupling with wire 7. This is due to a layout of the plug that has wire 3 next to wire 2, and wire 6 next to wire 7 (e.g., see FIG. 2).

Figure 7A:
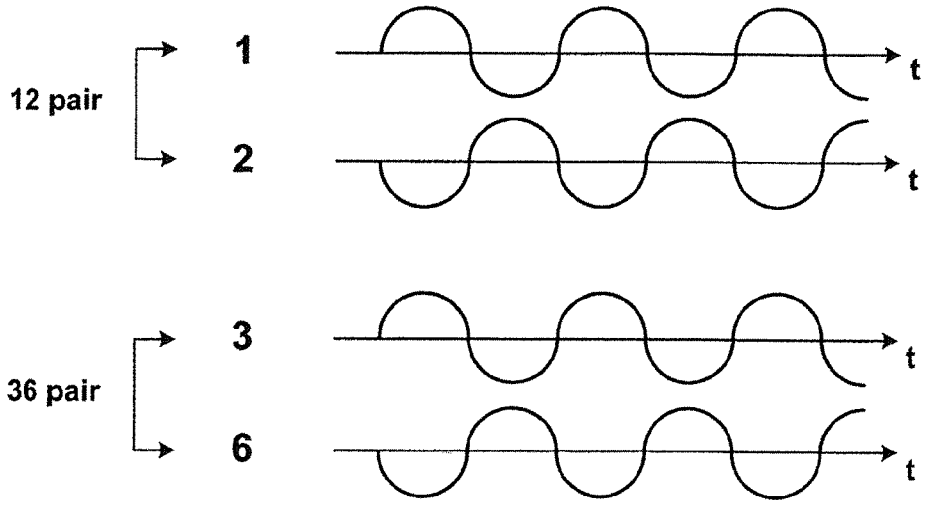
FIG. 7A illustrates examples of conceptual differential signals transmitted along wire pairs 12 and 36.

FIG. 7A illustrates conceptual differential signals transmitted along wire pairs 12 and 36. As shown, using differential signaling, the signal sent along wire 1 is 180 degrees out of phase with the signal sent along wire 2. The same occurs with the signals transmitted across wires 3 and 6. Due to the layout of the wires in a cable, there is crosstalk caused by the plug between wires of each pair that have signals of one phase (e.g., wires 1 and 3, and wires 2 and 6), and between wires of each pair that have signals of an opposite phase (e.g., wires 1 and 6, and wires 2 and 3). To compensate for crosstalk caused by the plug, compensation is added that is of a polarity opposite the crosstalk caused by the plug, so that the crosstalk caused by the plug between wires of each pair that have signals in phase cancels with crosstalk caused by the plug between wires of each pair that have signals out of phase. Thus, it is desired to create a situation where together the plug and jack have:

$$X_{13}+X_{26}-X_{23}-X_{16}\approx 0 \quad (1)$$

for wire pairs 36-12, where $X_{13}$ is compensating crosstalk added between wires 1 and 3, $X_{26}$ is compensating crosstalk added between wires 2 and 6, $X_{23}$ is crosstalk by the plug between wires 2 and 3, and $X_{16}$ is crosstalk between wires 1 and 6.

Figure 7B:
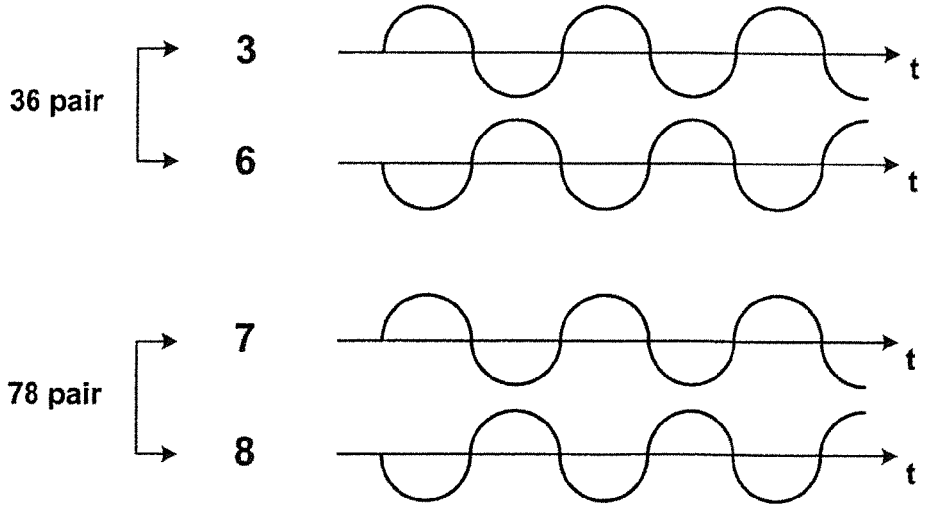
FIG. 7B illustrates examples of conceptual differential signals transmitted along wire pairs 36 and 78.

In addition, the same situation occurs for wire pairs 36-78, as shown in FIG. 7B, and thus it is desired to create a situation where together the plug and jack have:

$$X_{68}+X_{37}-X_{67}-X_{38}\approx 0 \quad (2)$$

where $X_{68}$ is compensating crosstalk added between wires 6 and 8, $X_{37}$ is compensating crosstalk added between wires 3 and 7, $X_{67}$ is crosstalk between wires 6 and 7, and $X_{38}$ is crosstalk between wires 3 and 8. Note that the X may refer to capacitive and/or inductive crosstalk. The reason every equation is written as approximately zero is that while being equal to exactly zero is desired, most of the time the actual value is around the magnitude of below −75 dB at frequencies below 10 MHz due to the dynamic range of the test equipment, imperfections in the assembly process, and the use of different types of plugs.

In CAT6 and CAT6A specifications, additional crosstalk is generally time-delayed with respect to first stage compensating capacitors ($X_{13}$, $X_{26}$ and $X_{68}$, $X_{37}$). The crosstalk is of the same polarity to the plug ($X_{23}$, $X_{16}$ and $X_{67}$, $X_{38}$). The second crosstalk generally results in the addition of a null that increases the bandwidth of the system. Equations 1 and 2 are still met for this to work. For more information regarding time-delay signal compensation, the reader is referred to U.S. Pat. No. 5,997,358, the contents of which are entirely incorporated by reference, as if fully set forth herein.

An additional source of crosstalk is alien crosstalk (e.g., signal coupling from adjacent channels). The plug/jack interface is a source of the signals that ultimately cause alien crosstalk. For example, an imbalance in the plug blade layout with respect to wire pairs 36-12 and 36-78 creates common mode signals. Wires 3 and 2 are close to each other and wires 6 and 7 are close to each other, and therefore a differential signal on pair 36 generates a strong common mode signal on wire pairs 12 and 78. The common mode signals on wire pairs 12 and 78 couple between adjacent cables on adjacent channels. These common mode signals on wire pairs 12 and 78 on the adjacent channel then become converted back into a differential signal on wire pair 36 that is the alien crosstalk.

To be compliant to the Telecommunications Industry Association (TIA)/Electronic Industries Alliance (EIA) CAT6A specifications and ISO standards, the plug should have a de-embedded crosstalk value in a specific range for each pair combination. For example, for pair combination 12 to 36 and 36 to 78, the value is:

$$46.5-20\log(f/100)\text{dB} \geqq \text{TotalXtalk} \geqq 49.5-20\log(f/100)\text{dB} \quad (3)$$

where TotalXtalk is the de-embedded crosstalk for pair combinations 12 to 36 and 36 to 78 in dB, and f is a frequency in MHz.

The total crosstalk for pairs 12 and 36, and 36 and 78 that creates the de-embedded value defined as TotalXtalk in Equation 3 can be viewed as that in Equations 1-2 above. Because of the layout of the plug where the blades for 2 and 3 are next to each other and 6 and 7 are next to each other, $$X_{23} >> X_{16} \quad (4)$$

and $$X_{67} >> X_{38} \quad (5)$$

It is the imbalance on $X_{12\text{-}36}$ and $X_{36\text{-}78}$ that creates a strong common mode signal on wire pairs 12 and 78.

Figure 8:
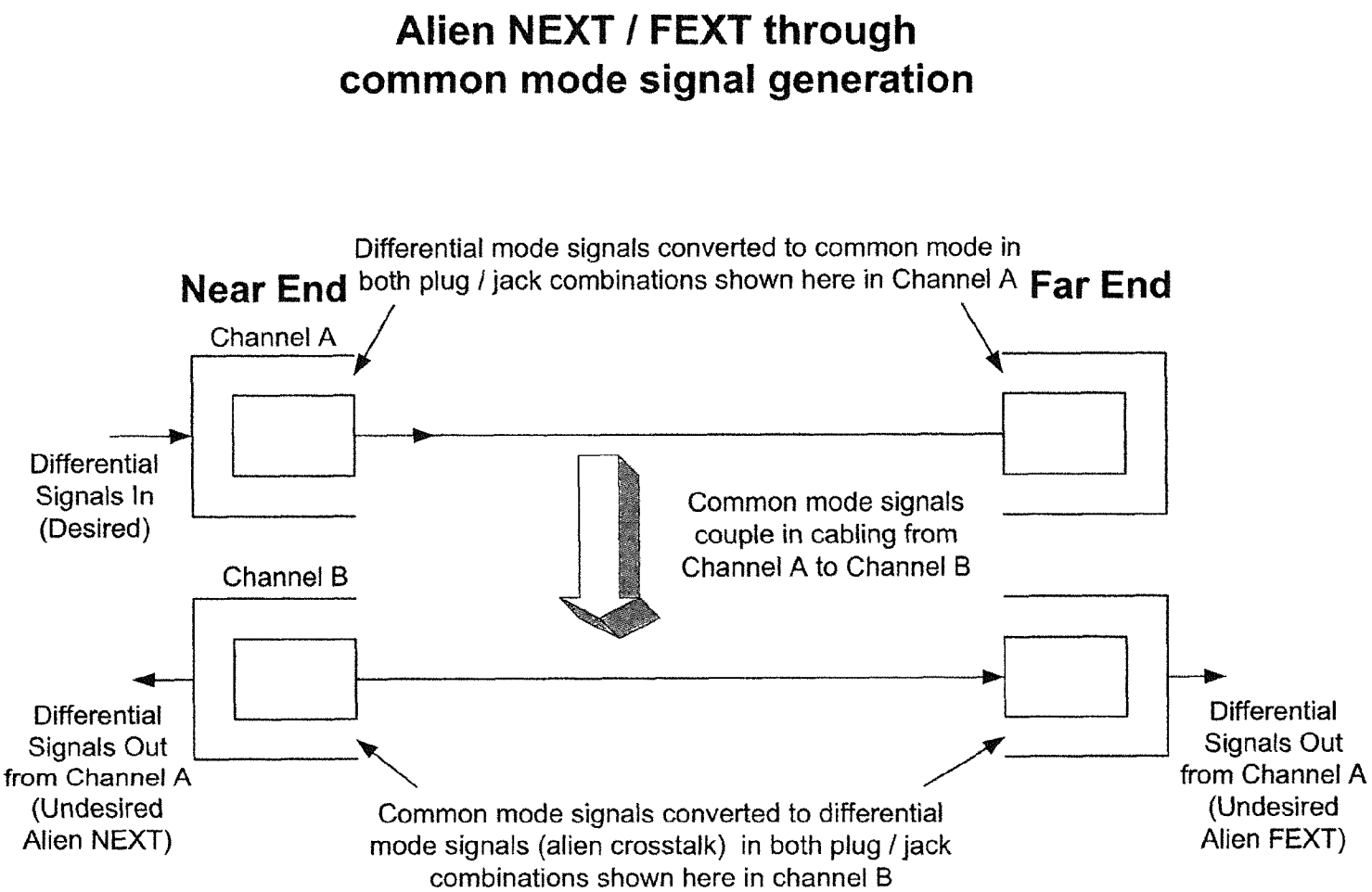
FIG. 8 illustrates how common mode generation from a plug/jack connection creates alien crosstalk seen in a channel.

FIG. 8 illustrates how common mode signals created at a plug/jack connection will create alien crosstalk. Initially a differential signal is injected onto Channel A (e.g., a first cable). The plug/jack combinations on Channel A will convert the differential signal into a common mode signal. This "mode conversion" (e.g., conversion from a differential signal to a common mode signal or a common mode signal into a differential signal) occurs predominantly due to a configuration of the blades on the plug and/or how the compensation for the plug is performed in the jack.

The common mode signal also couples over as an alien crosstalk signal onto the patch cable of Channel B. The coupling of common mode signals on cabling is not covered in CAT6A standards, and hence is usually at a much stronger level than differential coupling. On Channel B, the plug-jack combinations convert the common mode signal back into a differential signal which causes alien crosstalk on Channel B.

Thus, two problems exist: the generation of common mode signals by the plug/jack connection and the coupling of these signals in the cabling. Hence, factors influencing the total amount of alien crosstalk caused by the plug/jack mode conversion include the mode conversion from differential to common mode and common mode back to differential, and the level of coupling between adjacent cables for the common mode signal. It is desirable to reduce the amount of mode conversion in the plug/jack connection.

In one embodiment, in addition to meeting the requirements of Equations 1 and 2 above, new requirements are needed to reduce mode conversion. Hence, the values of the added crosstalk within the plug/jack combination (capacitance and inductance values) are generally as shown below:

$$C_{13} \approx C_{26} \approx C_{23} \approx C_{16} \quad (6)$$

$$C_{68} \propto C_{37} \propto C_{67} \propto C_{38} \quad (7)$$

$$M_{13} \propto M_{26} \propto M_{23} \propto M_{16} \quad (8)$$

and $$M_{68} \propto M_{37} \propto M_{67} \propto M_{38} \quad (9)$$

where C refers to the total capacitive coupling and M refers to the total mutual inductive coupling of a mated plug/jack combination. If Equations 6-9 are met, the total amount of mode conversion that creates the 12/78 common mode signals from a 36 differential signal would be minimized. Creating a jack that is close to meeting equations 6, 7, 8, and 9 can be difficult due to the fact that the structure of the jack itself adds in inductive and capacitive components that are difficult to quantify. Note that while these equations shown balanced coupling required for pair combinations 36-12 and 36-78, these balanced requirements are needed for all pairs (45-36, 45-12, 45-78, and 12-78).

Figure 9:
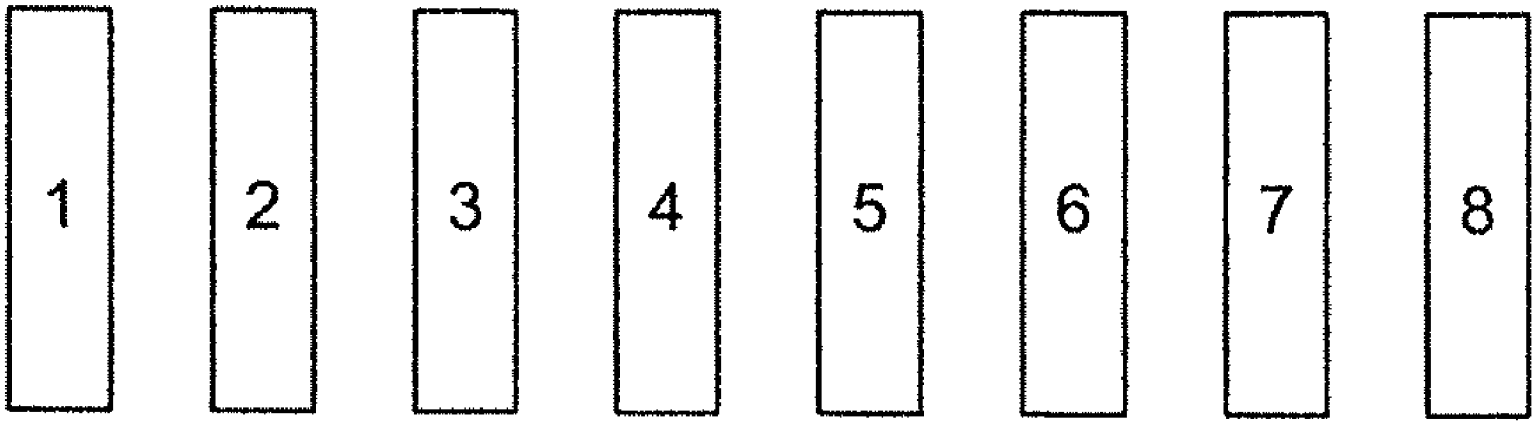
FIG. 9 illustrates an example plug blade layout with the blades numbered according to the number of the wire that terminates to the blade.

Referring to FIGS. 3-5, within the present application, capacitive crosstalk can be added in both the flex board 320 and the PCB rigid board 314 of the jack 304. To optimize mode conversion, capacitance compensation is added between wires 1 and 3 and wires 2 and 6 to compensate for the plug crosstalk on the pair combination 12-36, and compensation can be added between wires 3-7 and 6-8 to compensate for the plug crosstalk on the pair combination 36-78 in order for the plug/jack to be compliant with internal NEXT specifications. For example, equal capacitance can be added between wires 1-3 and 2-6, and between wires 3-7 and 6-8 to satisfy Equations 6-7. FIG. 9 illustrates a plug blade layout, with the blades numbered according to the number of the wire that terminates to the blade.

To tune for Internal NEXT and mode conversion at the same time in the jack, the capacitances $C_{13}$, $C_{26}$, $C_{68}$, and $C_{37}$ are made to be substantially equal in magnitude. Likewise, capacitances $C_{68}$ and $C_{37}$ are made to be substantially equal in magnitude. Capacitors of the same polarity as the crosstalk from the plug, time-delayed with respect to the above capacitors are added in the form of $C_{16}$ and $C_{38}$.

Figure 10:
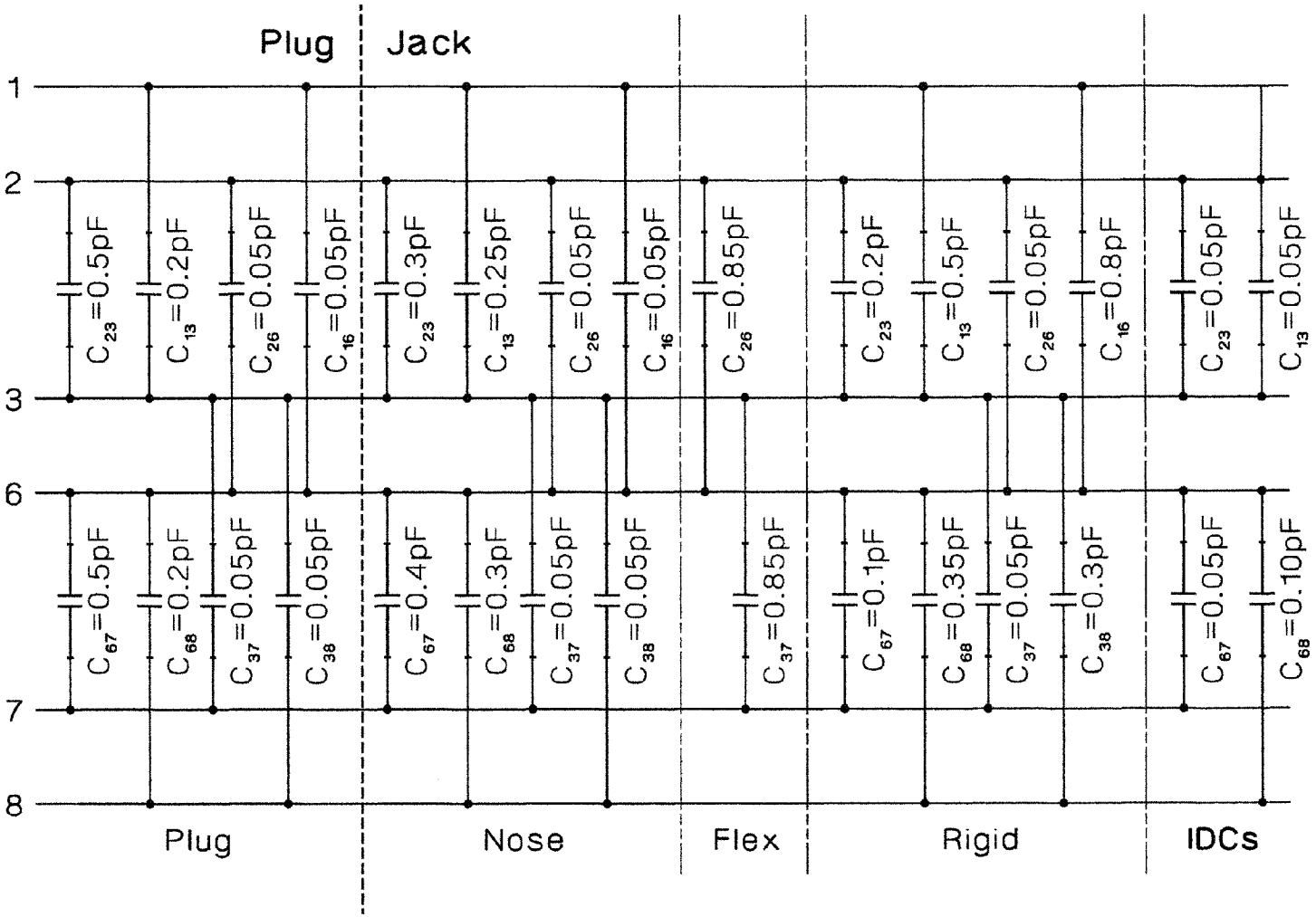
FIG. 10 illustrates an example schematic diagram showing capacitances between wire pairs 36, 12, and 78 of a plug/jack designed to optimize internal NEXT, FEXT, and to reduce common mode creation for wire pair combinations 36-12 and 36-78.

Therefore, the plug/jack compensation to tune for mode conversion and internal NEXT for wire pair combinations 36-12 and 36-78 may be that as shown in FIG. 10. As shown, the plug, due to its geometry, primarily supplies capacitances $C_{23}$ and $C_{67}$, which are equal in value. The plug also supplies capacitances $C_{13}$ and $C_{68}$ that are equal in value. Note that the plug is also shown to include capacitances $C_{37}$, $C_{38}$, $C_{26}$, and $C_{16}$ that are equal in value; however, these capacitances are theoretical values that are not physically added into the plug, but rather shown to illustrate that they may be present due to the design of the plug.

A nose of the jack (e.g., bottom front sled 308, top front sled 310 and interface contacts 312 altogether) supplies capacitances $C_{13}$ and $C_{68}$ due to its geometry, as well as capacitances $C_{67}$ and $C_{23}$. Capacitances $C_{26}$, $C_{37}$, $C_{16}$, and $C_{38}$ are theoretically present within the nose and are shown for completeness. The flex board adds capacitances $C_{26}$ and $C_{37}$, which are equal in value. The rigid board adds capacitances $C_{16}$ and $C_{38}$, and capacitances $C_{68}$ and $C_{13}$. Capacitances $C_{67}$, $C_{37}$, $C_{26}$, and $C_{23}$ are theoretical capacitances shown for completeness. To the right of the rigid board as shown in FIG. 10, within the IDCs, capacitances $C_{67}$, $C_{68}$, $C_{13}$, and $C_{23}$ are added. FIG. 10 illustrates example values for each capacitance, however, other values may also be used. In addition, the values shown in FIG. 10 satisfy Equations 6 and 7 to within in about 0.1 pF.

Figure 11:
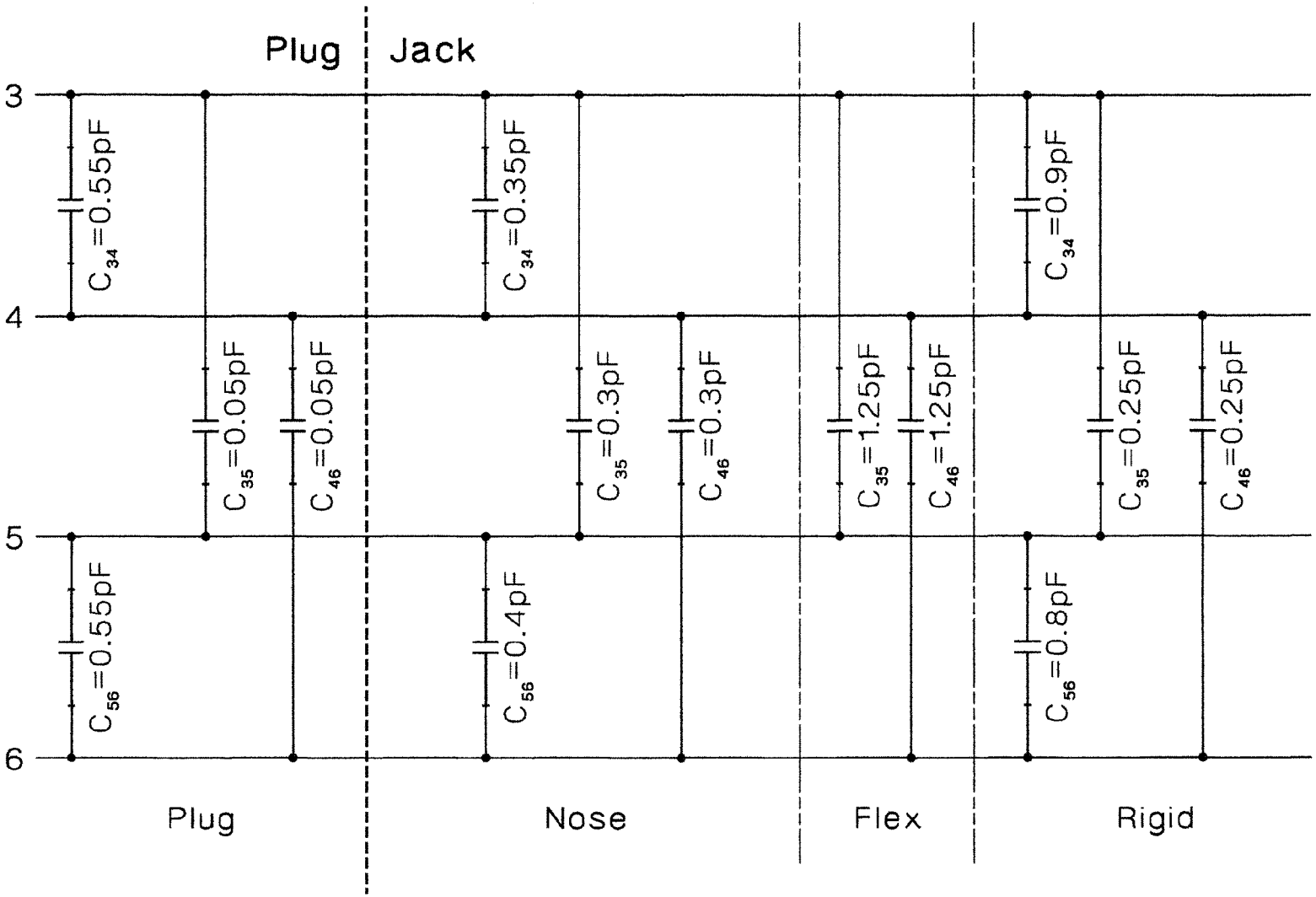
FIG. 11 illustrates an example schematic diagram showing capacitances added between wire pair combination 45-36.

FIG. 11 illustrates wire pair capacitances for wire pairs 34, 35, 46, and 56. Using the same methods as above, it is desired to create a situation where $$X_{34}+X_{56}-X_{46}-X_{35} \propto 0 \quad (10)$$

where $X_{34}$ is compensating crosstalk added between wires 3 and 4, $X_{56}$ is compensating crosstalk added between wires 5 and 6, $X_{46}$ is crosstalk between wires 4 and 6, and $X_{35}$ is crosstalk between wires 3 and 5.

As shown in FIG. 11, the plug has capacitances $C_{34}$, $C_{56}$, $C_{35}$, and $C_{46}$. The nose of the jack has capacitances $C_{34}$, $C_{56}$, $C_{35}$, and $C_{46}$ added to compensate for the net crosstalk caused by the plug. The flex board has capacitances $C_{35}$ and $C_{46}$ added to compensate for crosstalk. The rigid board has $C_{34}$, $C_{56}$, $C_{35}$, and $C_{46}$ added to compensate for crosstalk. Therefore any mode conversion with respect to pair combination 45 and 36 is minimized as well.

Figure 12:
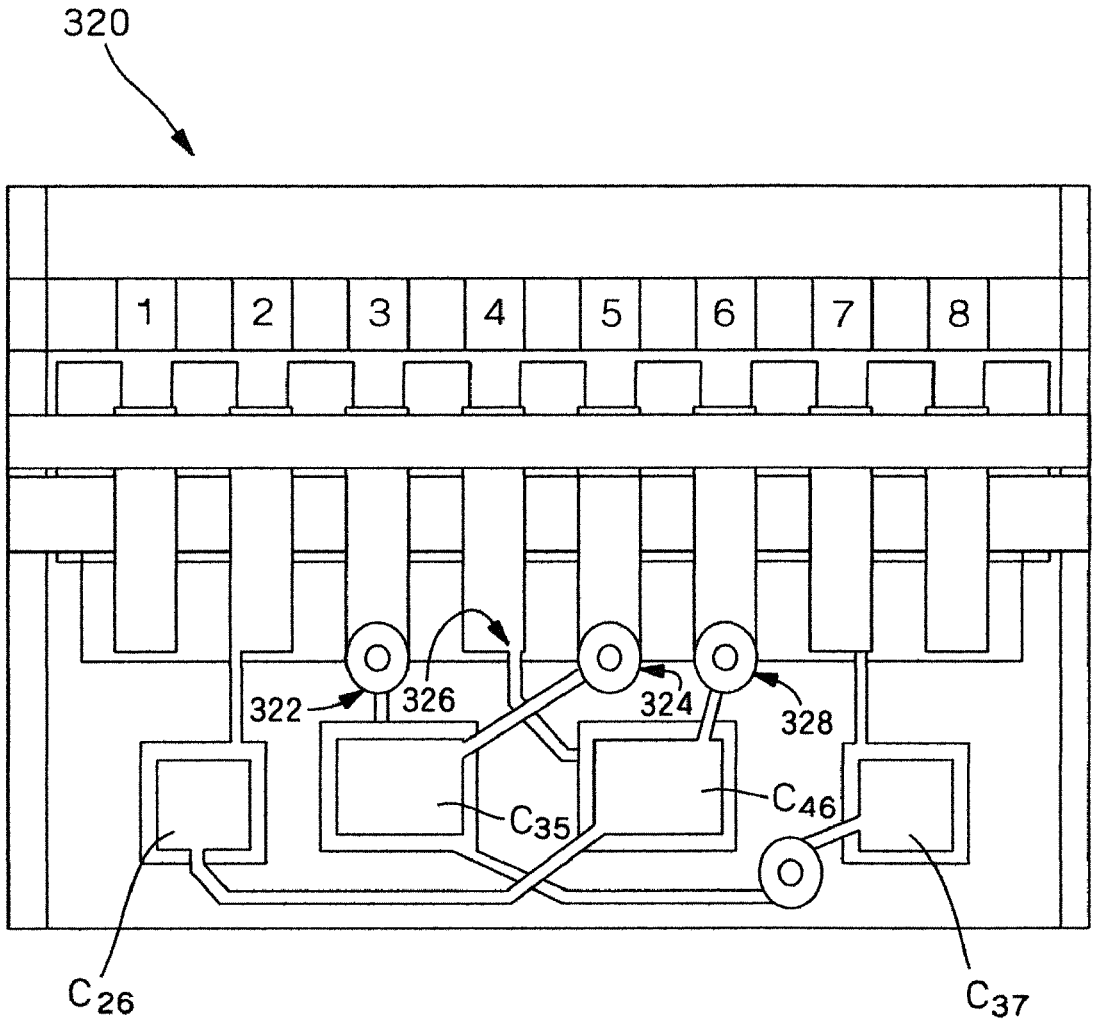
FIG. 12 illustrates an example layout of a flex board of a jack designed to optimize internal NEXT and reduce the common mode creation on wire pairs 12 and 78.

FIG. 12 illustrates an example layout of the flex board 320, with points of contact for the wires numbered 1-8. The flex board 320 may be a two-layer board with a 1 mil core between the two layers. The flex board 320 is shown to include capacitances $C_{26}$, $C_{35}$, $C_{46}$ and $C_{37}$. The capacitors are physically two layers of metal, and a size of a top layer of $C_{26}$ and $C_{37}$ may be 28×33 mil, and a size of a bottom layer of $C_{26}$ and $C_{37}$ may be 38×43 mil. In addition, a size of a top layer of $C_{35}$ and $C_{46}$ may be 30×44 mil, and a size of a bottom layer of $C_{35}$ and $C_{46}$ may be 40×54 mil. Different size capacitors are used to prevent layer-to-layer variation by a manufacturing process from affecting the flex board's overall capacitance value.

In the present application, the flex board adds only compensating capacitive crosstalk between wires 26, 37, 35, and 46 that is of opposite polarity of the crosstalk added in the plug area. The flex board does not add any intentional inductive crosstalk. By placing the capacitors on the flex board of opposite polarity to the couplings in the plug on the flex board, the capacitors are placed closer to the plug, which gives better internal NEXT performance.

The flex board design shown in FIG. 12 attempts to minimize a distance from wire contacts 322 and 324 to the capacitor $C_{35}$, and minimize a distance from wire contacts 326 and 328 to capacitor $C_{46}$ to allow for better internal NEXT performance through the time delay model. The flex board also improves alien crosstalk when measured in the channel by helping balance out the 36-12 and 36-78 wire pairs by omitting capacitance on the flex board between wire pairs 13 and 68.

Figure 13:
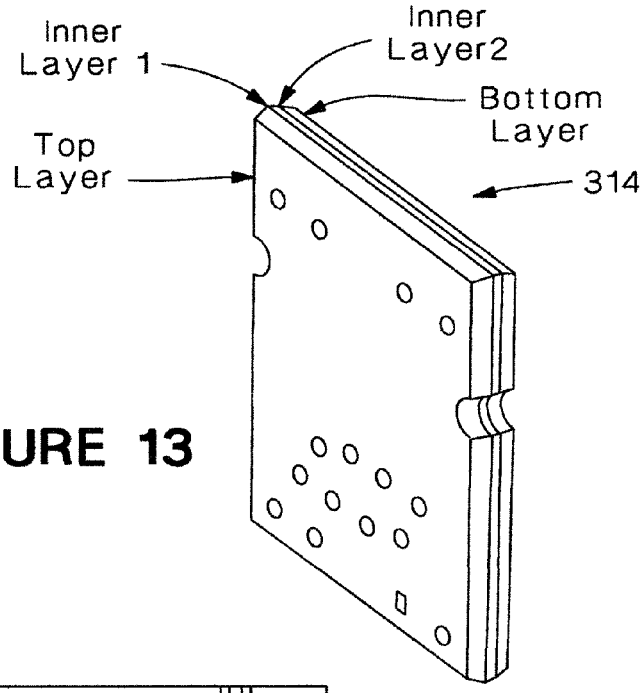
FIG. 13 illustrates an enlarged example layout view of the rigid board from FIG. 3.
Figure 14:
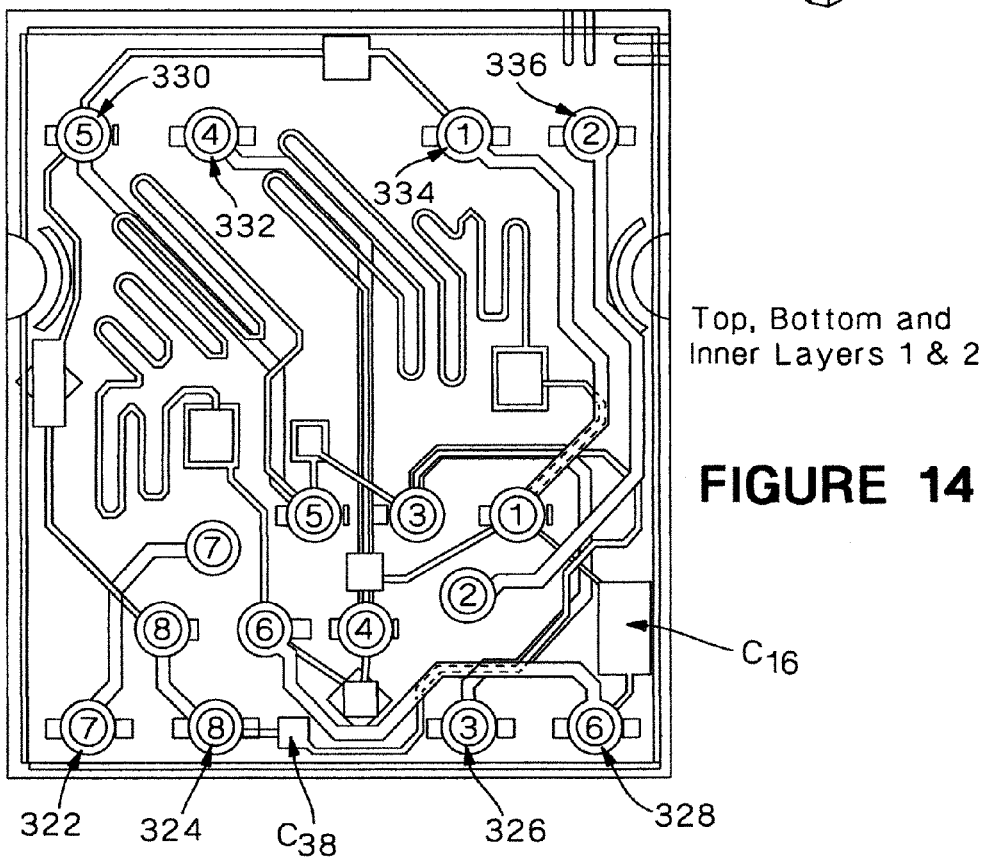
FIG. 14 illustrates an example layout of the rigid board showing a top layer, a first inner layer, a second inner layer, and a bottom layer.

FIG. 13 illustrates an enlarged view of the rigid board 314 from FIG. 3, and FIG. 14 illustrates an example layout of the rigid board. As shown in FIG. 13, the rigid board 314 includes a top layer, a first inner layer, a second inner layer, and a bottom layer. FIG. 14 illustrates a top view showing conductive traces on all four layers. IDC contacts (as shown in FIG. 6) are shown here labeled with reference numbers 322-336. Each of the IDC contacts 322-336 is connected to a pinout of a corresponding wire on the rigid board 314 (numbered 1-8) from the interface contacts 312. Thus, the IDC contacts are shown numbered 1-8, of which numbers corresponding to wires 1, 2, 4 and 5 are at one end of the rigid board, and numbers 3, 6, 7 and 8 are at the other end of the rigid board. The pinouts of interface contacts are shown in the middle of the rigid board. Notable capacitances $C_{38}$ and $C_{16}$ are also shown in FIG. 14.

Figure 15A:
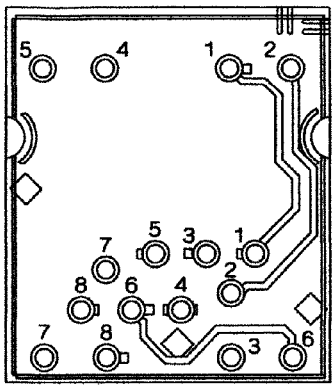
FIGS. 15A-F show example views of the different layers of the rigid board.
Figure 15D:
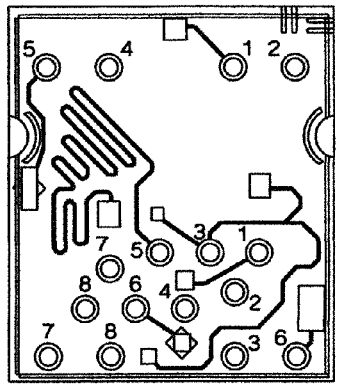
Figure 15B:
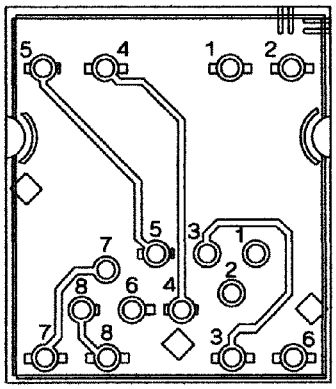
Figure 15E:
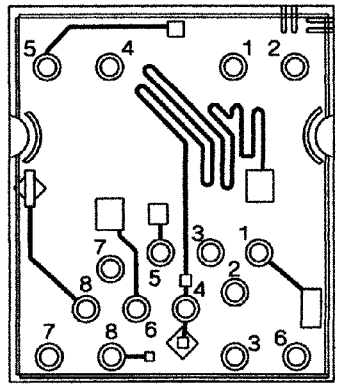
Figure 15C:
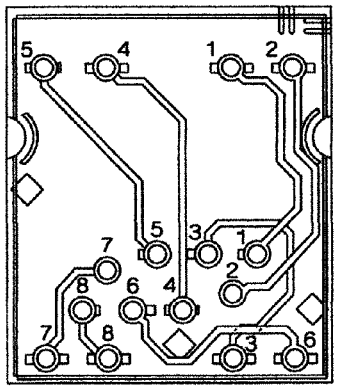

FIGS. 15A-F show the different layers of conductive traces of the rigid board 314. For example, FIG. 15A shows the top layer of the rigid board 314. As shown, the top layer includes traces that connect the pinouts of wires 1, 2, and 6 to the IDC contacts for those corresponding wires. FIG. 15B shows the bottom layer of the rigid board 314. As shown, the bottom layer includes traces that connect the pinouts of wires 3, 4, 5, 7, and 8 to the IDC contacts for those corresponding wires. FIG. 15C illustrates an example view of both the top and bottom layers to illustrate all connections between the pinouts and the IDC contacts.

Figure 15F:
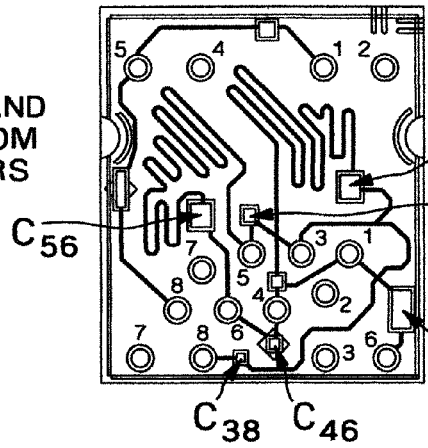

FIG. 15D illustrates an example view of a first inner layer of the rigid board 314 and FIG. 15E illustrates an example view of a second inner layer of the rigid board 314. The first and second inner layers include the plates that comprise capacitances $C_{56}$, $C_{38}$, $C_{46}$, $C_{16}$, $C_{35}$, and $C_{34}$. For example, the first inner layer includes a first plate for each of capacitances $C_{56}$, $C_{38}$, $C_{46}$, $C_{16}$, $C_{35}$, and $C_{34}$, and the second inner layer includes a second plate for each of capacitances $C_{56}$, $C_{38}$, $C_{46}$, $C_{16}$, $C_{35}$, and $C_{34}$, so that together they form the stated capacitors, as shown in FIG. 15F.

Figure 16A:
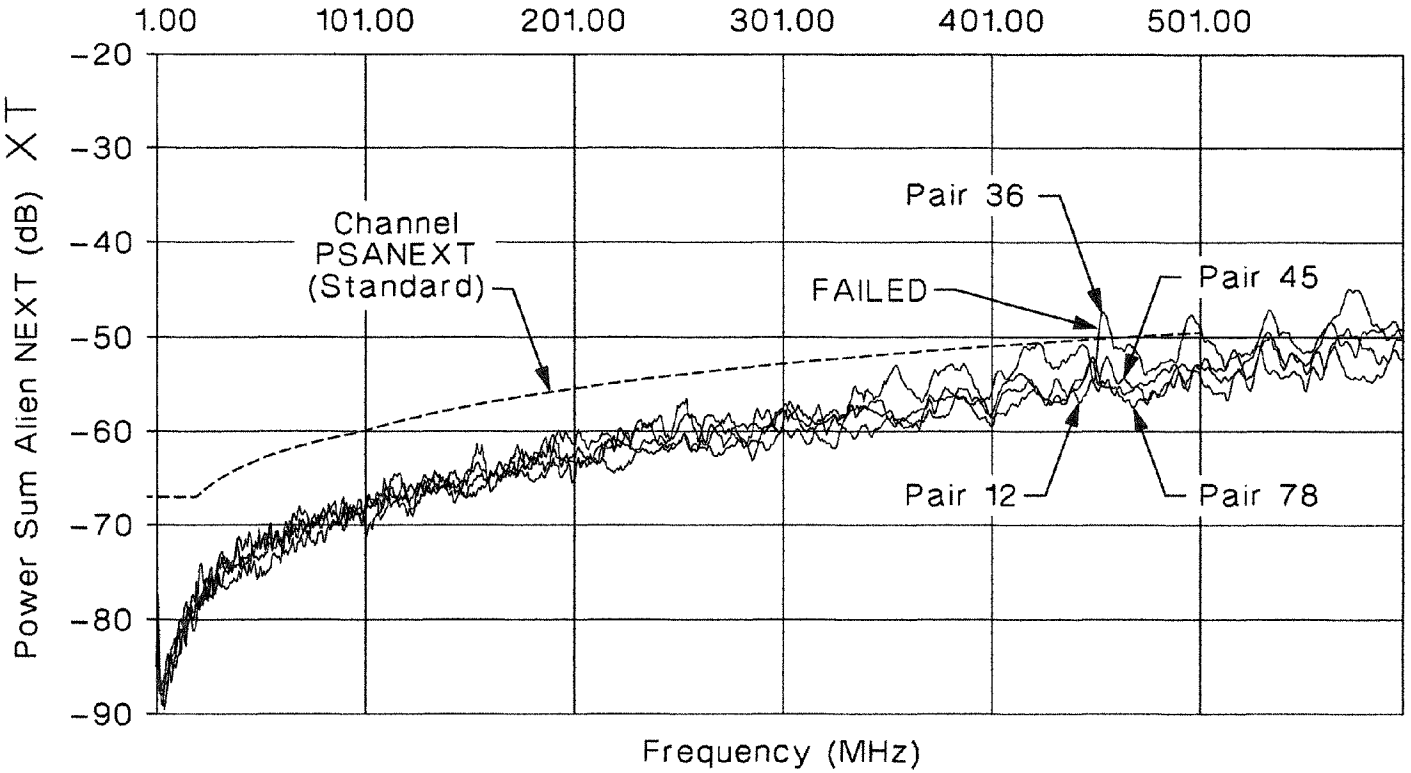
FIGS. 16A-B illustrate example standard laboratory tests performed to illustrate benefits of the present application.
Figure 16B:
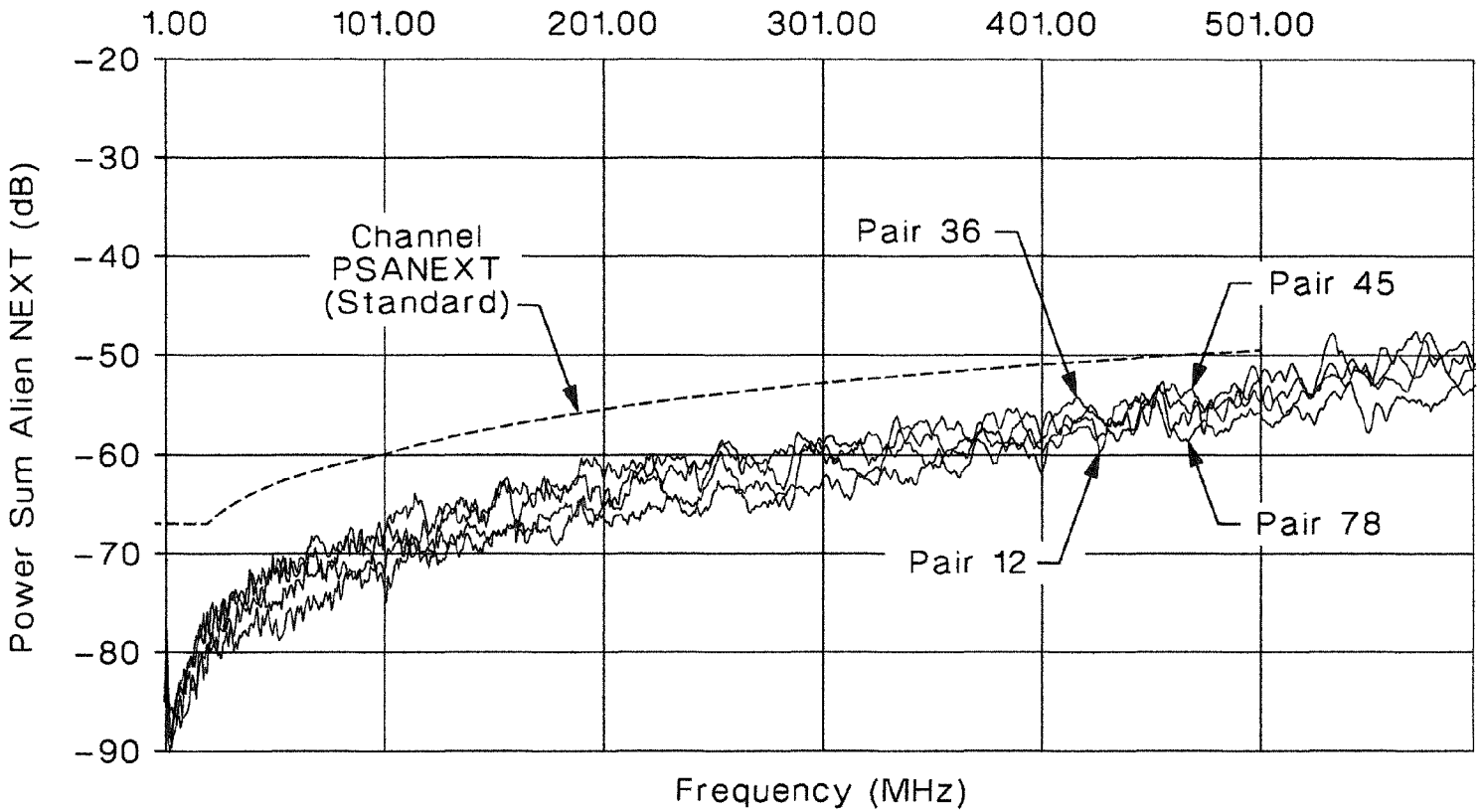

FIGS. 16A-B illustrate example simulations performed to illustrate benefits of the present application. The simulations were run to illustrate a 6-around-1 power sum alien NEXT test. The test illustrates crosstalk seen on a cable due to six surrounding cables. Within FIG. 16A, the simulation was run using the plug/jack combination discussed herein with a configuration such that Equations 1 and 2 above were true, and Equations 6-9 above were not true. As shown, using this configuration (e.g., an unbalanced structure), the system fails to comply with the standard allowance for alien crosstalk at about 450 MHz. FIG. 16B is an example simulation run with the plug/jack combination discussed herein (with example capacitance values shown in FIG. 10) with a configuration such that Equations 1-2 and 6-9 were true. As shown, using this configuration (e.g., a balanced structure), the system complies with the standard allowance for crosstalk up through 500 MHz.

Using the methods described herein, with a standard 8-wire twisted paired cable and RJ45 plug/jack connection, alien crosstalk between cables and common mode signals generated in the jack can be lessened. To compensate for crosstalk caused by the plug, the net crosstalk of the jack is of a polarity opposite that of the plug so that together the plug and jack have crosstalk that cancels each other out (e.g., Equations 1 and 2 above). In addition, the values of the added crosstalk (capacitance and inductance values) are generally equivalent so that the crosstalk will be canceled.

Furthermore, while examples of the present application focus on compensating for crosstalk using capacitance, crosstalk may also or alternatively be compensated for by using balanced inductance values as well.

Of course, many changes and modifications (including, but not limited to, dimensions, sizes, shapes, orientation, etc.) are possible to the embodiments described above. It is important to note that while the embodiments have been described above with regard to a specific configuration and designs of a plug/jack connection, the underlying methods and techniques of the present application for crosstalk cancellation are also applicable to other designs. For example, the underlying methods for crosstalk cancellation can be used with cables and plug/jack connections of other types that are designed for use in other electrical communication networks that do not employ RJ-45 plugs and jacks.

It should be understood that arrangements described herein are for purposes of example only. As such, those skilled in the art will appreciate that other arrangements and other elements can be used instead, and some elements may be omitted altogether according to the desired results. Further, many of the elements that are described are functional entities that may be implemented as discrete or distributed components or in conjunction with other components, in any suitable combination and location.

It is intended that the foregoing detailed description be regarded as illustrative rather than limiting, and it is intended to be understood that the following claims including all equivalents define the scope of the invention.

What is claimed is:

1. A communication jack configured to mate with an unbalanced plug and twisted pair communication cable comprising:

a housing;

a plurality of plug interface contacts contained within the housing;

circuitry configured to minimize internal near end crosstalk and internal far end crosstalk; and circuitry configured to minimize differential mode to common mode and common mode to differential mode signal conversion within a mated combination of the communication jack and unbalanced plug.

2. The communication jack of claim 1, wherein the jack includes a sled arranged to support the plug interface contacts for connecting to the unbalanced plug.

3. The communication jack of claim 1, wherein the jack includes a rigid board that connects to the plug interface contacts, and a flex board that contacts the plug interface contacts.

4. The communication jack of claim 3, wherein a portion of the circuitry configured to minimize internal near end crosstalk and internal far end crosstalk and a portion of the circuitry configured to minimize differential mode to common mode and common mode to differential mode signal conversion is included within the rigid board.

5. The communication jack of claim 3, wherein a portion of the circuitry configured to minimize internal near end crosstalk and internal far end crosstalk and a portion of the circuitry configured to minimize differential mode to common mode and common mode to differential mode signal conversion is included within the flex board and the rigid board.

6. The communication jack of claim 1, wherein the twisted pair communication cable is compatible with Category 6A cabling.

7. The communication jack of claim 1, wherein the twisted pair communication cable is compatible with Category 6 or Category 5E cabling.

8. A communication jack configured to mate with an unbalanced plug and twisted pair communication cable comprising:

a housing;

a plurality of plug interface contacts contained within the housing;

circuitry contained within the housing, said circuitry configured to simultaneously minimize internal near end crosstalk, internal far end crosstalk, and differential mode to common mode and common mode to differential mode signal conversion.

9. The communication jack of claim 8, wherein the jack includes a sled arranged to support the plug interface contacts for connecting to the unbalanced plug.

10. The communication jack of claim 8, wherein the jack includes a rigid board that connects to the plug interface contacts, and a flex board that contacts the plug interface contacts.

11. The communication jack of claim 10, wherein a portion of the circuitry is included within the rigid board.

12. The communication jack of claim 10, wherein a portion of the circuitry is included within the flex board and the rigid board.

13. The communication jack of claim 8, wherein the twisted pair communication cable is compatible with Category 6A cabling.

14. The communication jack of claim 8, wherein the twisted pair communication cable is compatible with Category 6 or Category 5E cabling.

15. The communication jack of claim 8 wherein the plurality of plug interface contacts consists of eight contacts linearly aligned such that the contacts can be numbered from 1 to 8 starting at a first end and ending at an opposite end and wherein the circuitry is further configured such that when the unbalanced plug is mated with the communication jack, the capacitances between contacts 1 and 3, contacts 2 and 6, contacts 2 and 3, and contacts 1 and 6 are all approximately equal.

16. The communication jack of claim 15 wherein the circuitry is further configured such that the capacitance between contacts 3 and 4 is approximately equal to the capacitance between contacts 3 and 5.

17. The communication jack of claim 16 wherein the circuitry is further configured such that the capacitance between contacts 5 and 6 is approximately equal to the capacitance between contacts 4 and 6.

18. The communication jack of claim 17 wherein the circuitry is further configured such that the capacitances between contacts 6 and 8, contacts 3 and 7, contacts 6 and 7, and contacts 3 and 8 are all approximately equal.

19. The communication jack of claim 17, wherein a portion of the circuitry is included within a flex board and a rigid board.

20. The communication jack of claim 19 wherein the flex board contains only capacitive crosstalk compensation between contacts 2 and 6, 3 and 7, 3 and 5, and 4 and 6.

* * * * *

UNITED STATES PATENT AND TRADEMARK OFFICE

CERTIFICATE OF CORRECTION

PATENT NO. : 8,128,437 B2
APPLICATION NO. : 13/095412
DATED : March 6, 2012
INVENTOR(S) : Frank M. Straka et al.

It is certified that error appears in the above-identified patent and that said Letters Patent is hereby corrected as shown below:

Column 5, line 42 which reads "$X_{68}+X_{37}-X_{67}-X_{38}\infty 0$" should read "$X_{68}+X_{37}-X_{67}-X_{38} \approx 0$".

Column 6, line 67 which reads "$C_{13}\infty C_{26}\infty C_{23}\infty C_{16}$" should read "$C_{13} \approx C_{26} \approx C_{23} \approx C_{16}$".

Column 7, line 1 which reads "$C_{68}\infty C_{37}\infty C_{67}\infty C_{38}$" should read "$C_{68} \approx C_{37} \approx C_{67} \approx C_{38}$".

Column 7, line 3 which reads "$M_{13}\infty M_{26}\infty M_{23}\infty M_{16}$" should read "$M_{13} \approx M_{26} \approx M_{23} \approx M_{16}$".

Column 7, line 8 which reads "$M_{68}\infty M_{37}\infty M_{67}\infty M_{38}$" should read "$M_{68} \approx M_{37} \approx M_{67} \approx M_{38}$" .

Column 8, line 5 which reads "$X_{34}+X_{56}-X_{46}-X_{35}\infty 0$" should read "$X_{34}+X_{56}-X_{46}-X_{35} \approx 0$".

Signed and Sealed this
Sixteenth Day of October, 2012

David J. Kappos

David J. Kappos
*Director of the United States Patent and Trademark Office*